US006000299A

United States Patent [19]

Cole

[11] Patent Number: 6,000,299

[45] Date of Patent: Dec. 14, 1999

[54] MODULAR TOOL SYSTEM

[75] Inventor: James E. Cole, Dallas, Tex.

[73] Assignee: Splined Tools Corporation, Richardson, Tex.

[21] Appl. No.: 08/940,816

[22] Filed: Sep. 30, 1997

Related U.S. Application Data

[62] Continuation-in-part of application No. 08/876,488, Jun. 16, 1997, Pat. No. 5,775,184, which is a continuation of application No. 08/541,509, filed as application No. PCT/US95/03841, Mar. 28, 1995, which is a continuation-in-part of application No. 08/260,720, Jun. 16, 1994, Pat. No. 5,419,221.

[51] Int. Cl.[6] ..... B25B 13/46

[52] U.S. Cl. ..... 81/60; 81/58.3; 81/58.4; 81/177.7; 81/177.8

[58] Field of Search ..... 81/58–58.4, 60–63.2, 81/177.7–177.9, 177.2; 403/84.91, 97, 359

[56] References Cited

U.S. PATENT DOCUMENTS

| | | |
|---|---|---|
| 14,270 | 10/1856 | Luff . |
| 151,315 | 5/1874 | Rowe . |
| 928,375 | 7/1909 | Frick . |
| 1,077,575 | 11/1913 | Wutke . |
| 1,109,032 | 9/1914 | Bersted . |
| 1,568,442 | 1/1926 | Carver . |
| 1,840,685 | 1/1932 | Witherup . |
| 2,420,132 | 5/1947 | Gryniuck . |
| 2,603,325 | 7/1952 | Pickard . |
| 2,671,367 | 3/1954 | Modin . |
| 2,691,316 | 10/1954 | Brame . |
| 2,921,773 | 1/1960 | Hoelzer . |
| 3,002,409 | 10/1961 | Jones . |
| 3,039,339 | 6/1962 | Hanson . |
| 3,175,436 | 3/1965 | Coleman . |
| 3,188,895 | 6/1965 | Jones . |
| 3,270,597 | 9/1966 | Neff et al. . |
| 3,314,318 | 4/1967 | Shoults . |
| 4,027,558 | 6/1977 | Fish . |
| 4,270,417 | 6/1981 | Tesoro . |
| 4,406,186 | 9/1983 | Gummow . |
| 4,479,409 | 10/1984 | Antonius . |
| 4,596,167 | 6/1986 | White, Jr. . |
| 4,747,328 | 5/1988 | Howard . |
| 4,774,862 | 10/1988 | Scull . |
| 4,794,829 | 1/1989 | Mesenhoeller . |
| 4,800,785 | 1/1989 | Christensen . |
| 4,901,608 | 2/1990 | Shieh . |
| 5,386,747 | 2/1995 | Grover . |
| 5,419,221 | 5/1995 | Cole . |
| 5,471,899 | 12/1995 | Twomlow . |
| 5,522,287 | 6/1996 | Chiang . |

FOREIGN PATENT DOCUMENTS

| | | |
|---|---|---|
| 3023882A1 | 1/1982 | Germany . |

*Primary Examiner*—D. S. Meislin
*Attorney, Agent, or Firm*—Richard J. Veltman

[57] ABSTRACT

A modular tool system includes a tool head, a handle, and an intermediate piece disposed therebetween. The handle includes a first pin for coupling the handle to the intermediate piece and the intermediate piece includes a second pin for coupling the intermediate piece to the tool head. The first and second pins each include a splined portion for engaging splined orifices in the handle and intermediate pieces, respectively, and a shank for removably engaging shank-receiving orifices in the intermediate piece and the tool head, respectively. When the shanks are engaged with their respective shank-receiving orifices, the handle can be moved along the first pin to selectively lock the handle to the intermediate piece and the intermediate piece can be moved along the second pin to selectively lock the intermediate piece to the tool head. The handle can also be moved along the first pin to selectively unlock the handle for rotational movement about the pin relative to the intermediate piece and the intermediate piece can be moved along the second pin to unlock the intermediate piece for rotational movement about the pin relative to the to the tool head. If desired, the intermediate piece can be removed and the handle can be coupled directly to the tool head by inserting the first pin into the tool head's shank-receiving orifice.

4 Claims, 5 Drawing Sheets

MODULAR TOOL SYSTEM

The present application is a CIP of U.S. application Ser. No. 08/876,488 filed Jun. 16, 1997, now U.S. Pat. No. 5,775,184, which is a FWC of U.S. application Ser. No. 08/541,509 filed Oct. 10, 1995, now abandoned, which is a nationalization of PCT application Ser. No. PCT/US95/03841 filed Mar. 28, 1995, which is a CIP of U.S. application Ser. No. 08/260,270 filed Jun. 16, 1994, now U.S. Pat. No. 5,419,221 issued May 30, 1995, the disclosures of which are incorporated herein by reference.

The invention relates to adjustable tools. More particularly, the invention relates to modular tool systems having a handle, a tool head, an intermediate piece disposed between the tool head and the handle, and a plurality of connecting pins connecting the intermediate piece to the tool head and handle to allow adjustment of the tool head to a plurality of positions relative to the handle and the intermediate piece.

BACKGROUND OF THE INVENTION

A tool including a preferred embodiment of the invention comprises a tool head, an intermediate piece, a plurality of connecting pins, and a handle. The tool head can include a conventional ratchet system for rotating a shank about an axis. A conventional socket or an open-end or closed-end crowfoot-type wrench can be connected to the shank.

The generally cylindrical connecting pin is aligned along an axis parallel to the shank axis and attached to the ratchet head. The connecting pins extend through splined orifices in the handle and intermediate piece, thereby connecting the handle to the intermediate piece and connecting the intermediate piece to the tool head. A portion of each connecting pin includes splines adapted to engage the orifice splines in a complementary manner to prevent rotation of the handle and intermediate piece about their respective connecting pin axis; and an indented portion adapted to allow the handle and intermediate piece to rotate freely about their respective connecting pin axis.

The handle and intermediate piece are slideable between a locked position and an unlocked position on their respective connecting pins. In the locked position, the splined orifice is disposed about the splined portion of the connecting pin, the orifice splines engage the connecting pin splines, and the ratchet wrench can be used to rotate a nut or bolt in a conventional manner. In the unlocked position, the orifice is disposed about the indented portion of the connecting pin and the ratchet head and intermediate piece can rotate in a full circle about the connecting pin axis. When the ratchet head and intermediate piece are in the desired position, the splined orifice is moved downwardly to engage the connecting pin splines, thereby allowing the ratchet head, intermediate piece and handle to be locked in any of a plurality of positions relative to each other.

When a nut or bolt to be rotated by the ratchet wrench is near an obstruction, the handle and/or the intermediate piece can be unlocked, rotated about its connecting pin axis, then locked, thereby adjusting the angle between the longitudinal axis of the handle and the longitudinal axis of the ratchet head. In many instances, such angular adjustment allows the ratchet wrench to be used to rotate the nut or bolt in the conventional manner while avoiding contact between the handle and the obstruction.

The construction of a ratchet wrench including a second embodiment of the invention is quite similar to that of the ratchet wrench described above. However, in the second embodiment, the handle and the intermediate piece orifices are smooth; that is, they lack the splines of the previous embodiment. Also, the portions of the connecting pin on which the orifices are disposed in the locked and unlocked positions are smooth. Splines are provided on a generally circular surface at the end of the handle and intermediate piece. In the locked position, the handle and intermediate piece splines engage complimentary splines on a rear surface of the intermediate piece and ratchet head, respectively, and the ratchet wrench can be used in a conventional manner. In the unlocked position, the handle and intermediate piece are free to rotate about their respective connecting pins. As with the ratchet wrench of the previous embodiment, the handle of the ratchet wrench can be adjusted relative to the longitudinal axis of the ratchet head to allow the ratchet wrench to be used to tighten or loosen a nut or bolt near an obstruction while avoiding contact between the wrench and the obstruction.

A breaker bar including a third embodiment of the invention comprises a handle and a connecting pin. As with the previous embodiment of the invention, the handle of the breaker bar includes a splined orifice at one end. The connecting pin includes a smooth portion, a splined portion, and a conventional shank. When the handle orifice is positioned about the smooth portion of the connecting pin (the "unlocked position"), the handle is free to rotate about the connecting pin. When the handle orifice is positioned about the splined portion of the connecting pin (the "locked position"), the handle orifice splines and connecting pin splines engage, thereby preventing rotation of the connecting pin. When a crowfoot-type wrench is connected to the shank, the handle can be moved to the unlocked position to allow the angular relationship between the crowfoot-type wrench and the handle to be adjusted.

BRIEF DESCRIPTION OF THE DRAWINGS

Tools embodying the invention will be described, by way of example only, with reference to the accompanying drawings, in which.

DETAILED DESCRIPTION OF THE DRAWINGS

Figure 1:
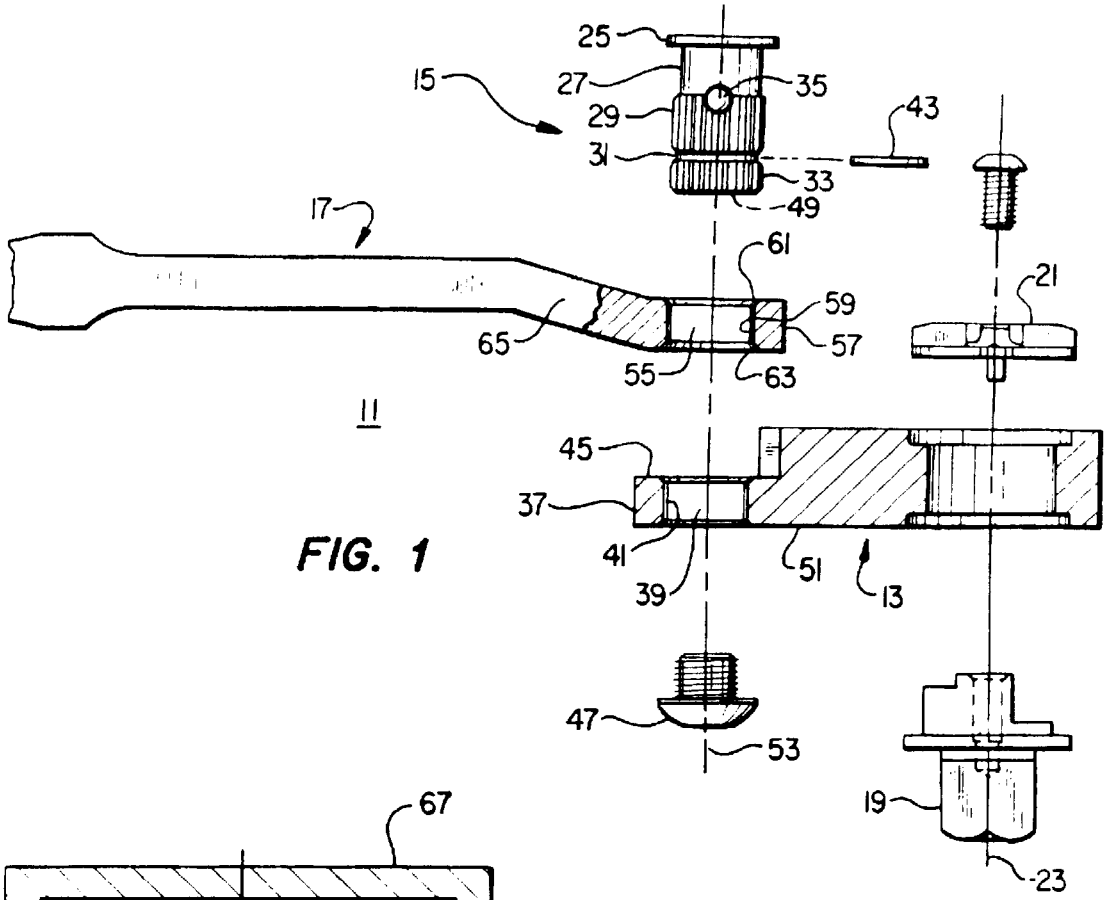
FIG. 1 is a partial, exploded side view of a ratchet wrench including the preferred embodiment of the invention.
Figure 2:
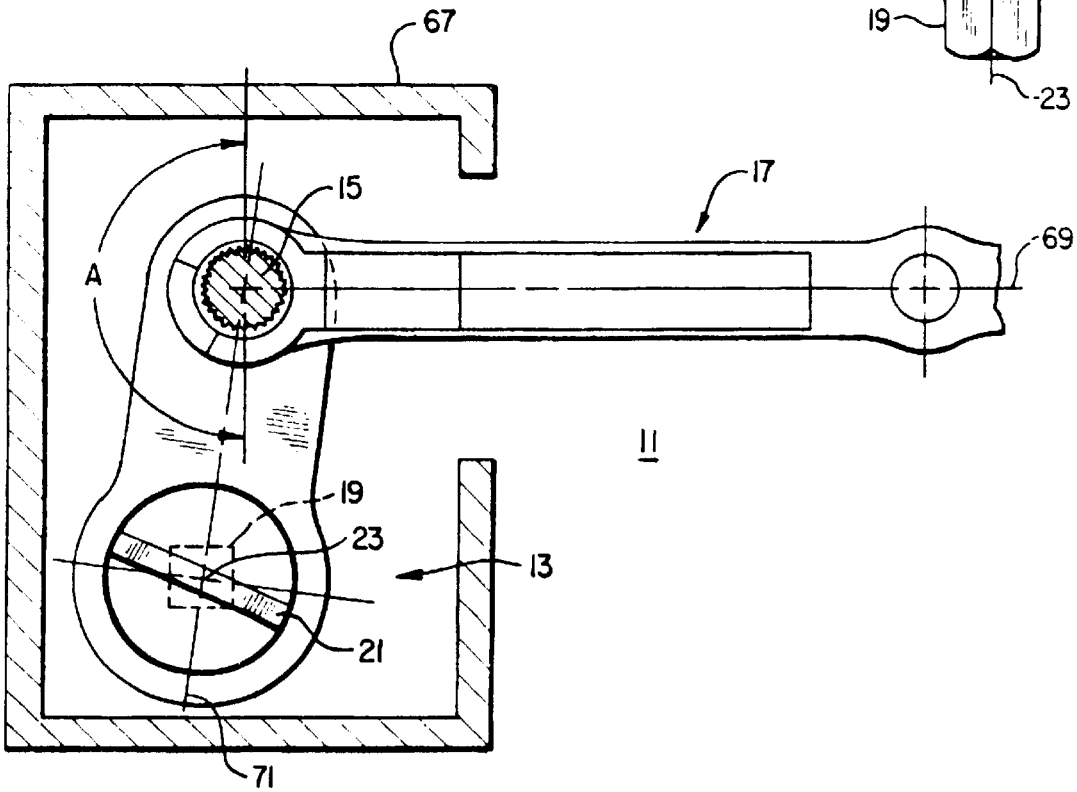
FIG. 2 is a partial top view of the ratchet wrench of FIG. 1 with the connecting pin cap cut away.

FIGS. 1 and 2 illustrate a tool or ratchet wrench 11 which includes a preferred embodiment of the invention. The ratchet wrench 11 comprises a ratchet head 13, a connecting pin 15, and a handle 17. The ratchet head 13 is provided with a conventional ratchet system which includes a shank 19 and a ratchet direction selector 21. The ratchet direction selector 21 can be positioned to cause the shank 19 to drive a connected socket (not shown) clockwise or counterclockwise about the shank axis 23.

From top to bottom in FIG. 1, the generally cylindrical connecting pin 15 comprises a radially extending cap 25, an indentation 27, upper splines 29, an annular groove 31, and lower splines 33. A spring-loaded detent ball 35 is provided in the connecting pin 15 at the juncture of the indentation 27 and the upper splines 29.

An integral arm 37 extending from the ratchet head 13 is provided with an orifice 39 having splines 41 adapted to engage the lower connecting pin splines 33 in a complementary manner. In the assembled ratchet wrench 11, the lower connecting pin splines 33 engage the arm orifice splines 41, a retaining ring 43 installed in the connecting pin groove 31 abuts an upper surface 45 of the arm 37, and a screw 47 engaged in a threaded orifice 49 in the connecting pin 15 abuts a lower surface 51 of the arm 37. As a result, the connecting pin 15 is attached to the arm 37 and aligned along an axis 53 that is parallel to the shank axis 23. Those skilled in the art will appreciate that the connecting pin 15 can be attached to the arm by other means, such as by press-fitting or adhesively bonding the arm orifice splines 41 and the connecting pin lower splines 33, thereby eliminating the need for the groove 31, retaining ring 43, screw 47, and connecting pin orifice 49.

An orifice 55 in an end 57 of the handle 17 adjacent to the ratchet head arm 37 is provided with splines 59, an upper chamfer 61, and a lower chamfer 63. In the assembled ratchet wrench 11, the handle orifice 55 is installed on the connecting pin 15 and is axially slideable thereon between an uppermost position and a lowermost position on the connecting pin 15. The connecting pin cap 25 and the ratchet head arm 37 cooperate to retain the handle end 57 on the connecting pin 15.

The detent ball 35 acts to retain the handle 17 in the uppermost and lowermost positions on the connecting pin 15. The upper and lower chamfers 61, 63, in combination with an appropriate spring load on the detent ball 35, allow the handle 17 to be moved easily between the uppermost and lowermost positions on the connecting pin 15.

When the handle 17 is in the uppermost position on the connecting pin 15, the handle orifice 55 is disposed about the connecting pin indentation 27. The diameter of the indentation 27 is slightly less than the inside diameter handle orifice splines 59. Hence, the handle 15 is free to rotate about the connecting pin 15 ("unlocked"). A step-up 65 in the handle 17 provides vertical clearance between the handle 17 and the ratchet direction selector 21, allowing the ratchet head 13 to rotate in a complete circle about the connecting pin 15. When the handle 17 is moved in a reciprocating manner, the ratchet shank 19 and attached socket (not shown) rotate about the ratchet shank axis 23 As a result, the handle 17 can be moved in a reciprocating manner to rapidly spin a nut or bolt (not shown) on or of f of a mating member (not shown). If an obstruction 67 prevents movement of the ratchet head 13 in a full circle, a combination of reciprocating handle motion and the action of the ratchet system will rotate a nut or bolt somewhat less rapidly, but more rapidly than with conventional ratchet action.

When the handle 17 is in the lowermost position on the connecting pin 15, the handle orifice 55 is disposed about the-upper connecting pin splines 29 and the handle orifice splines 59 engage the upper connecting pin splines 29, thereby preventing rotation of the handle 17 about the connecting pin 15. This allows the wrench 11 to be used in the conventional manner to drive the shank 19.

The angle between the longitudinal axis 69 of the handle 17 and the longitudinal axis 71 of the ratchet head 13 can be adjusted through an angle A of 180 degrees by unlocking the handle 17, rotating it about the connecting pin 15 to the desired position, then relocking it. This allows the ratchet wrench 11 to be used in instances in which an obstruction 67 prevents use of a conventional ratchet wrench. In this embodiment of the invention, there are 24 upper connecting pin splines 31, allowing the handle 17 to be locked in 13 different angular positions.

While the upper connecting pin splines 29 and the complementary handle orifice splines 59 provide the angular adjustment means in the preferred embodiment, it is to be understood that this aspect of the invention is not limited to members having splined cross sections. For example, virtually any regular polygonal cross-section could be used to perform the angular adjustment function.

Figure 3:
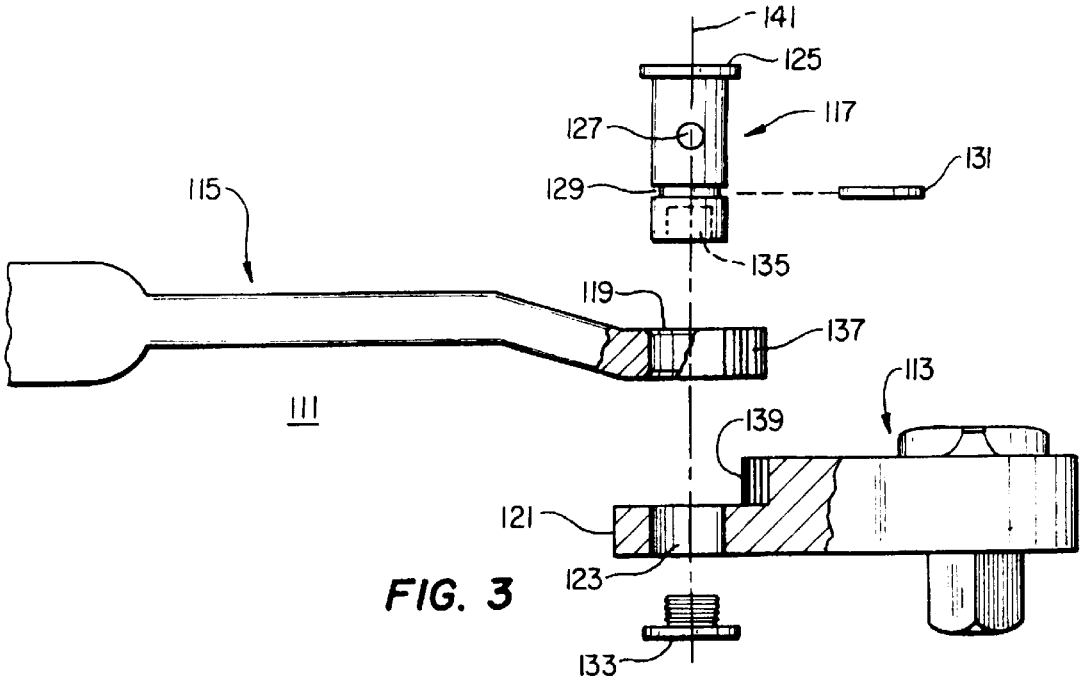
FIG. 3 is a partial, exploded side view of a ratchet wrench including a second embodiment of the invention.
Figure 4:
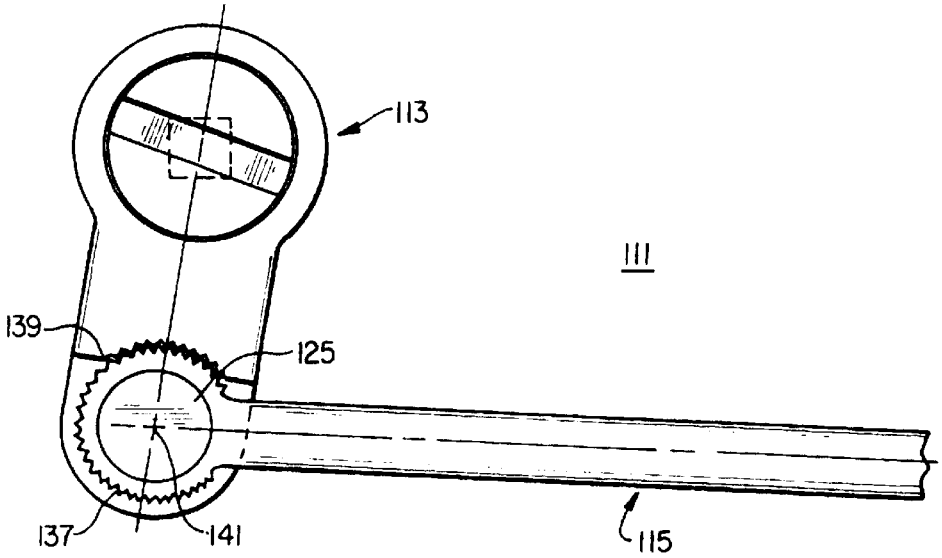
FIG. 4 is a partial top view of the ratchet wrench of FIG. 3.

FIGS. 3 and 4 illustrate a tool or ratchet wrench 111 which includes second embodiment of the invention. As with the preferred embodiment of FIGS. 1 and 2, a ratchet wrench 111 comprises a ratchet head 113 connected to a handle 115 by a connecting pin 117. Similarly, an orifice 119 is provided in the end of the handle 115 adjacent to the ratchet head 113, and an integral arm 121 extending from the ratchet head 113 is provided with an orifice 123. In this embodiment of the invention, the handle and ratchet head orifices 119, 123 are smooth, unlike the splined orifices 39, 55 of the preferred embodiment shown in FIGS. 1 and 2.

From top to bottom in FIG. 3, the cylindrical connecting pin 111 includes a radially-extending cap 125, a spring-loaded ball 127, and an annular groove 129. Except for the cap 125 and the groove 129, the diameter of the connecting pin 117 is constant along its length.

The handle orifice 119 is sized to provide a sliding fit with the connecting pin 117, and the ratchet head orifice 123 is sized to provide a press fit with the connecting pin 117. When the ratchet wrench 111 is assembled, the handle orifice 119 is positioned on the connecting pin 117 above the connecting pin groove 129, and a retaining ring 131 is installed in the groove 129. The connecting pin 117 is then press-fitted into the ratchet head orifice 123 until the retaining ring 131 abuts the upper surface of the ratchet head arm 121. Finally, a screw 133 installed in a threaded orifice 135 in the lower end of the connecting pin 117 abuts the lower surface of the ratchet head arm 121.

Figure 6:
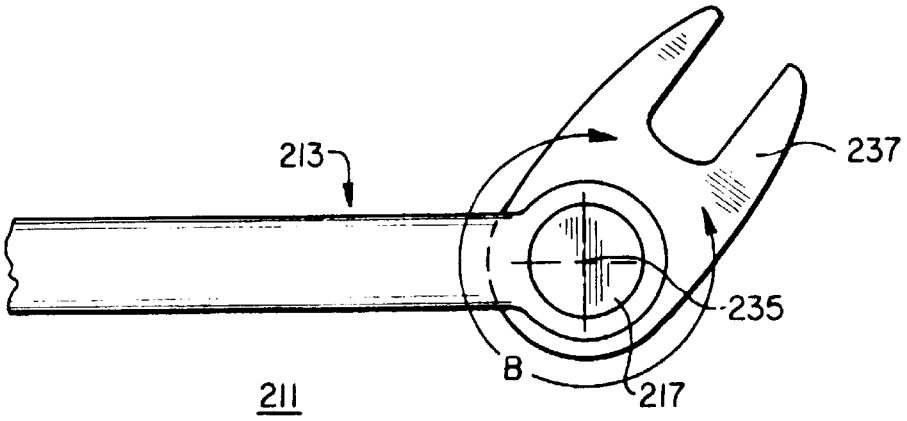
FIG. 6 is a top view of the breaker bar of FIG. 5.

When the handle 115 is in the lowermost position on the connecting pin 117 (below the spring-loaded ball 127), splines 137 on the end of the handle 1L5 engage complimentary splines 139 on a rear surface the ratchet head 113, thereby preventing rotation of the handle 115 about the connecting pin 117. As best seen in FIG. 6, the end of the handle 115 is generally circular, and the handle splines 137 extend approximately 280 degrees. The surface of the ratchet head 113 which contains the ratchet head splines 139 is arcuate and mates with approximately 90 degrees of the handle splines 137. When the handle 115 is in the uppermost position on the connecting pin 117 (above the spring-loaded ball 127), the handle 115 is free to rotate about the axis 141 of the connecting pin 117. Hence, when the handle 115 is in the uppermost position, it is "unlocked" from the ratchet head 113, and when the handle 113 is in the lowermost position it is "locked" to the ratchet head 113. Thus, as with the preferred embodiment, the handle 115 of this embodiment can be adjusted through an angle of 180 degrees relative to the longitudinal axis 141 of the ratchet head 113.

Figure 5:
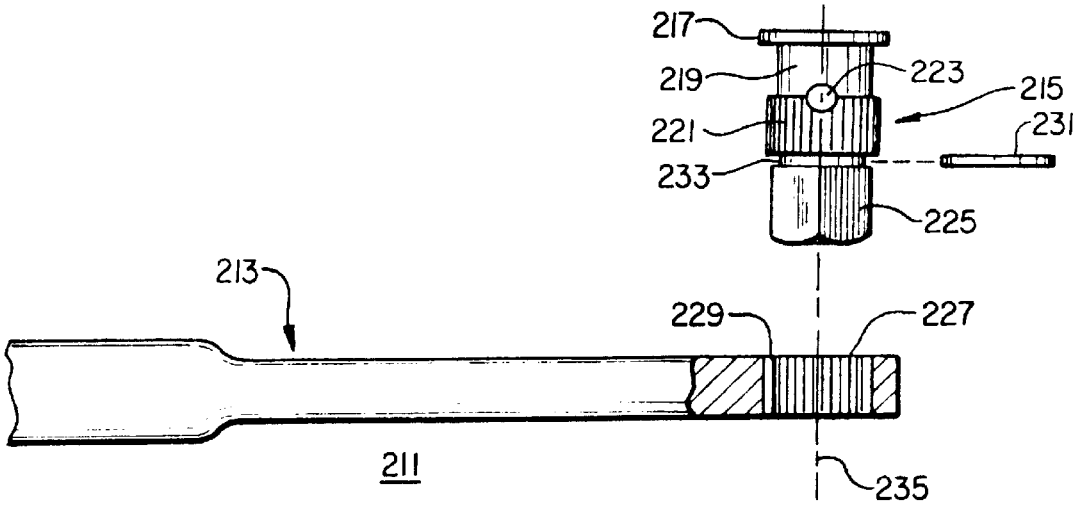
FIG. 5 is a partial, exploded side view of a breaker bar including a third embodiment of the invention.

FIGS. 5 and 6 illustrate a breaker bar 211 which includes a third embodiment of the invention. The breaker bar 211 comprises a handle 213 and a connecting pin 215. The connecting pin 215 includes a radially-extending cap 217, a smooth upper portion 219, a splined portion 221, and a springloaded ball 223, and a conventional shank 225. An orifice 227 having splines 229 which compliment the connecting pin splines 221 is provided in the end of the handle 213. The connecting pin splines 221 and the handle splines 229 are sized to allow the connecting pin 215 to slide axially through the handle orifice 227. When the wrench 211 is assembled, the connecting pin 215 passes through the handle orifice 227 and a retaining ring 231 engages a groove 233 between the shank 225 and the connecting pin splines 221. The retaining ring 231 prevents the connecting pin 215 from being pushed upwardly out of the handle orifice 227.

As with the ratchet wrench 11 shown in FIGS. 1 and 2, when the handle orifice 227 is in the uppermost position on the connecting pin 215, the handle 213 is free to rotate about the connection pin 215. When the handle 213 is in position over the connecting pin splines 221, the handle 213 and the connecting pin 215 are locked in position relative to the axis 235 of the connecting pin. As shown in FIG. 6, this allows angular adjustment between a conventional crowfoot-type wrench 237 and the handle 213 through an angle B of 360 degrees.

Figure 7:
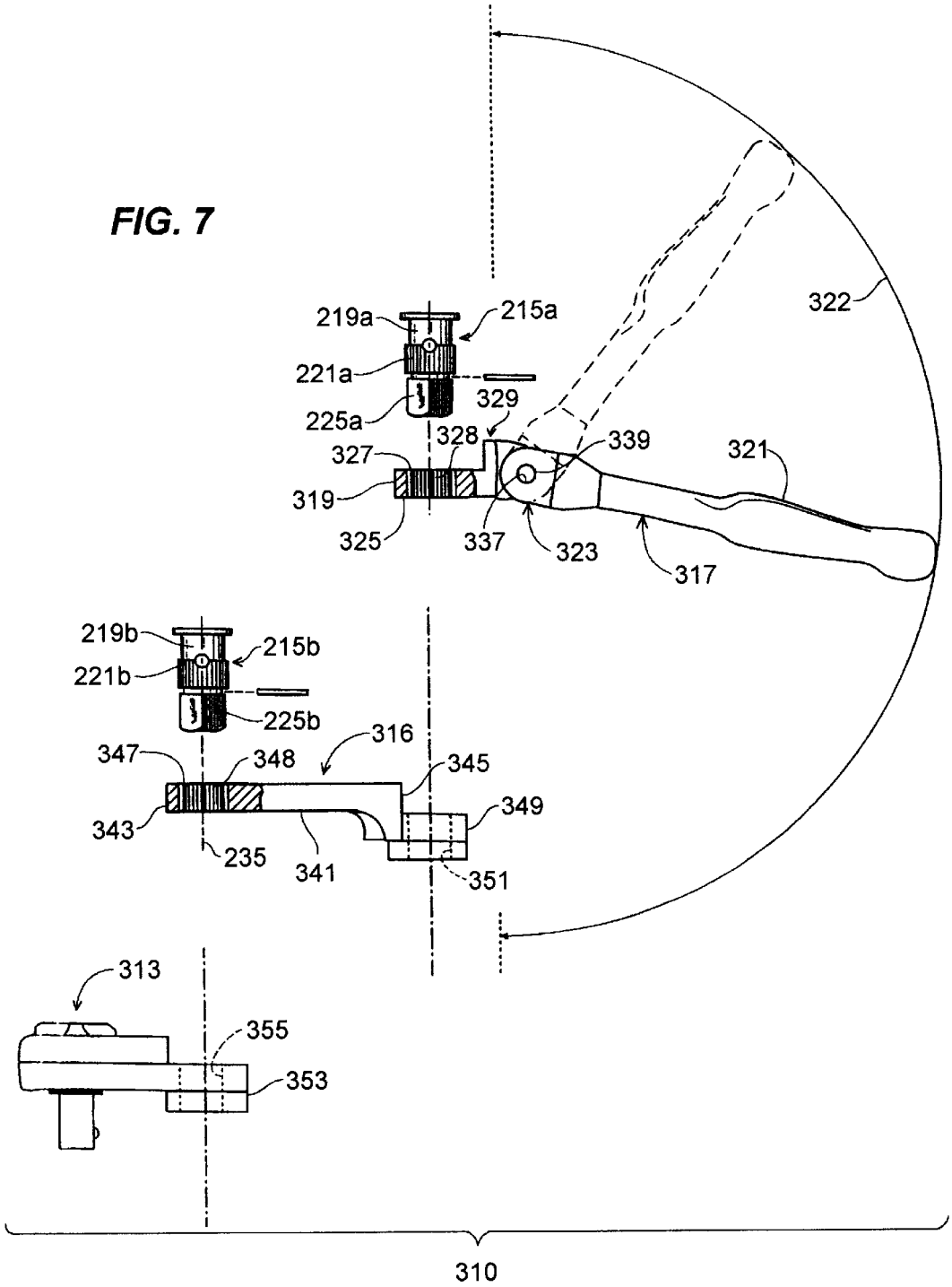
FIG. 7 is an exploded plan view of a modular tool system.
Figure 8:
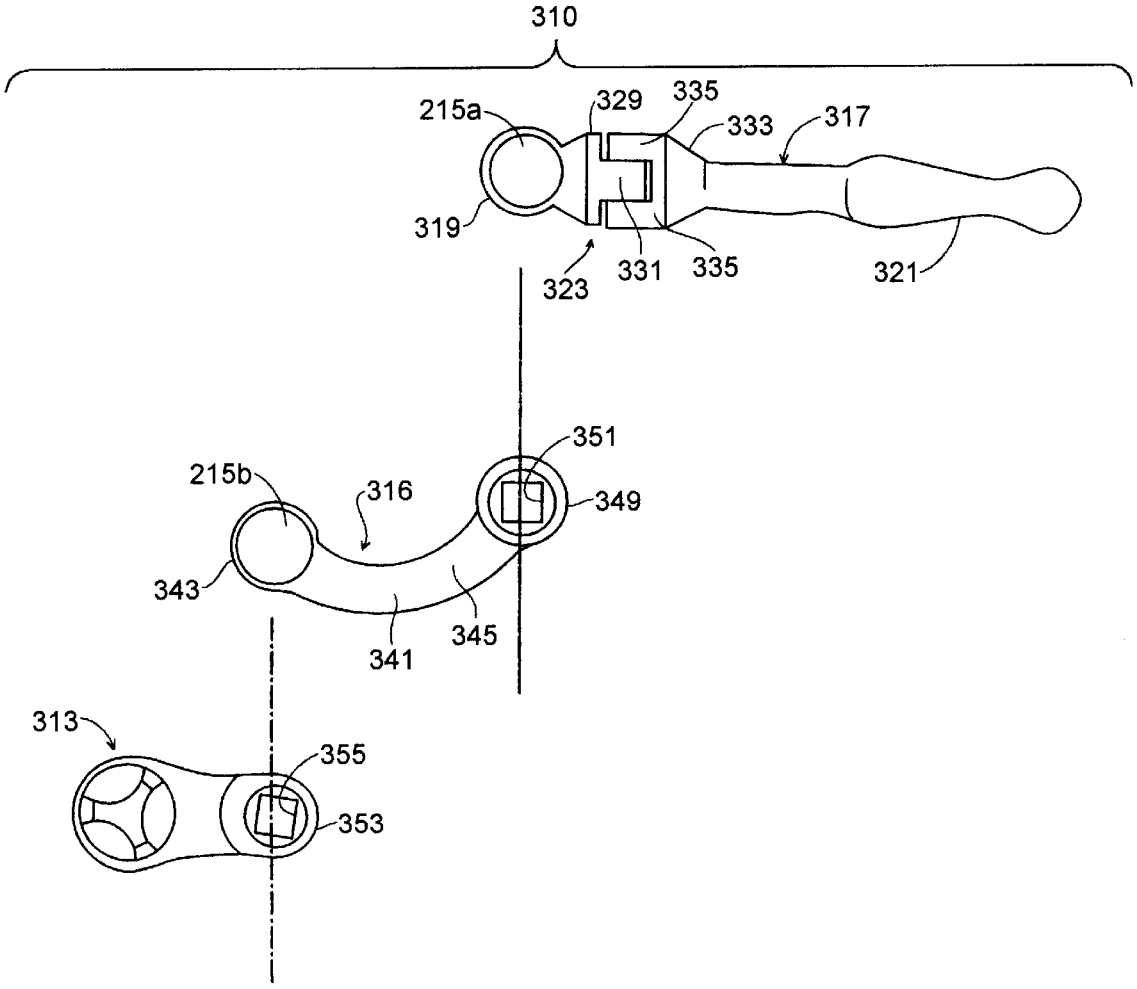
FIG. 8 is an exploded side view of the modular tool system.

A modular tool system 310 is illustrated in FIGS. 7 and 8. As illustrated, the tool system 310 includes a tool head 313, a plurality of connecting pins 215*a,* 215*b,* a handle 317, and an intermediate piece 316. The connecting pins 215*a,* 215*b* connect the the handle 317 and tool head 313 to the intermediate piece 316, respectively.

The handle 317 includes an engagement portion 319 and a hand grip portion 321 joined by a transverse pivot joint 323. The engagement portion 319 includes a first end 325 having a splined orifice 327 for receiving a connecting pin 215a and a second end 329 having a shoulder 331. The hand grip portion 321 includes a first end 333 having a pair of longitudinally extending arms 335. The arms 335 cooperate with the shoulder 331 to form the pivot joint 323. The shoulder 331 is disposed between the arms 335 and a pin-receiving bore 337 extends transversely through the arms 335 and shoulder 331 and receives a pivot pin 339. The pivot joint 323 allows the hand grip portion 321 to move along arc 322.

The intermediate piece 316 includes a bar 341 having a first end 343 and a second end 345. The first end 343 includes an orifice 347, having splines 348, for receiving connecting pin 215*b.* A shank-receiving portion 349 is attached to the second end 345 and is offset below the plane of the bar 341, as illustrated in FIG. 8. The shank-receiving portion 349 includes a shank-receiving orifice 351 configured to receive the shank 225*a* of connecting pin 215*a.* The bar 341 can be straight, curved to the right as shown in FIG. 8, or curved to the left.

The tool head 313 can be a conventional ratchet system, a crowfoot-type wrench, or the like, and includes a shank-receiving portion 353. The shank-receiving portion 353 includes a shank-receiving orifice 355 configured to receive the shank 225*b* of connecting pin 215*b.*

The shanks 225*a*, 225*b* are conventional ¼ inch, ½ inch, or ¾ inch drive shafts of the type generally used to drive sockets and the like. The shank-receiving orifices 351, 355 are sized and configured to receive the shanks 225*a,* 225*b.*

In use, the handle 317 includes a first connecting pin 215*a* fitted into the orifice 327 and the shank 225*a* is inserted into the shank-receiving orifice 351 of the intermediate piece 316 to couple the handle 317 to the intermediate piece 316. A second connecting pin 225*b* is fitted in the orifice 347 of the intermediate piece 316 and the shank 225*b* is inserted into the shank-receiving orifice 355 of the tool head 313 to couple the intermediate piece 316 to the tool head 313.

Once coupled to the intermediate piece 316, the handle 317 can be moved along the pin 215*a* between an engaged position and a disengaged position. In the engaged position, splines 221*a* of the pin 215*a* engage the splines 328 in the orifice 327 to rotationally lock the handle 317 to the intermediate piece 316. In the disengaged position, the handle 317 is moved upwardly on the pin 215*a* to align the orifice 327 with a smooth portion 219*a* of the pin 215*a,* allowing the handle 317 to freely rotate relative to the intermediate piece 316.

In a similar fashion, the intermediate piece 316 is coupled to the tool head 313. The intermediate piece 316 is movable between an engaged position, wherein the intermediate piece 316 is rotationally locked to the tool head 313, and a disengaged position, wherein the intermediate piece 316 is freely rotatable relative to die tool head 313. In the engaged position, splines 221*b* of the pin 215*b* engage the splines 348 in the orifice 347. In the disengaged position, the intermediate piece 316 is moved upwardly on the pin 215*b* to align the orifice 347 with a smooth portion 219*b*, allowing the intermediate piece 316 to freely rotate relative to the tool head 313.

Advantageously, the shanks 215*a,* 215*b* allow the handle 317, the intermediate piece 316, and the tool head 313 to be selectively interconnected. In particular, in one situation, it may be appropriate to remove the intermediate piece 316 and couple the handle 317 directly to the tool head 313. In another situation, it may be advantageous to include a "right-handed" intermediate piece in place of a "left-handed" intermediate piece. It may also be desirable to add several intermediate pieces between the handle and the tool head.

While wrenches embodying the invention have been shown and described, it will be apparent to those skilled in this art that various modifications may be made, such as replacing the ratchet head with other tools, or replacing "right-handed" intermediate pieces with "left-handed" intermediate pieces, without departing from the spirit of the present invention. For that reason, the scope of the invention is set forth in the following claims.

I claim:

1. A modular tool system comprising:

a tool head having a first orifice;

a handle having a first splined pin; and an intermediate piece having a first end and a second end, the first end having a second splined pin and the second end having a second orifice, the tool head and handle being coupled to the intermediate piece with the first splined pin being operatively disposed in the second orifice and the second splined pin being operatively disposed in the first orifice, the handle being movable between an engaged position and a disengaged position while coupled to the intermediate piece, the handle being rotationally locked to the intermediate piece in the engaged position, wherein each of the first and second pins includes a smooth portion, a splined portion and an engaging portion, the engaging portion being sized and configured to rotationally lock the pin in one of the first and second orifices, the splined portion being engaged by one of the intermediate piece and the handle to rotationally lock the one of the intermediate piece and the handle to the pin, the one of the intermediate piece and the handle being movable from the engaged position to the disengaged position by axial movement along the pin from the splined portion to the smooth portion.

2. A modular tool system comprising:

a tool head having a first spined pin;

a handle having a first orifice; and an intermediate piece having a first end and a second end, the first end having a second spine pin and the second end having a second orifice, the tool head and handle being coupled to the intermediate piece with the first splined pin being operatively disposed in the second orifice and the second splined pin being operatively disposed in the first orifice, the tool head being movable on the first pin between an engaged position and a disengaged position, the tool head being rotationally locked to the intermediate piece in the engaged position, and the intermediate piece being movable on the second pin between an engaged position and a disengaged position, the intermediate piece being rotationally locked to the handle in the engaged position, wherein each of the first and second pins includes a smooth portion, a splined portion and an engaging portion, the engaging portion being sized and configured to rotationally lock the pin in one of the first and second orifices, the splined portion being engaged by one of the intermediate piece and the tool head to rotationally lock the one of the intermediate piece and the tool head to the pin, the one of the intermediate piece and the tool head being movable from the engaged position to the disengaged position by axial movement along the pin from the splined portion to the smooth portion.

3. An intermediate piece for use with a modular tool system having a tool head and a handle, the intermediate piece comprising:

a bar having a first end and a second end, the first end including a first orifice; and a first splined pin coupled to the second end, the first splined pin including a smooth portion, a splined portion and an engaging portion, the splined portion being disposed between the smooth portion and the engaging portion, wherein the second end includes a splined orifice and the first splined pin is movable in the splined orifice, the intermediate piece being movable axially along the first splined pin between and engaged position and a disengaged position, the intermediate piece being rotationally locked to the first splined pin in the engaged position and being rotatable about the first splined pin in the disengaged position, the engaging portion of the first splined pin including a rectangular drive member and the first splined pin including means for limiting the axial movement of the intermediate piece to movement between the splined portion and the smooth portion.

4. The intermediate piece of claim 3 wherein the means for limiting the axial movement includes a retaining ring coupled to the splined pin between the rectangular drive member and the splined portion.

* * * * *